US005974817A

United States Patent [19]

Prummer

[11] Patent Number: 5,974,817

[45] Date of Patent: Nov. 2, 1999

[54] ASSEMBLY FOR CONTROLLING THE TEMPERATURE OF A FOUNTAIN FLUID AND/OR SELECTED ROLLERS OF A PRINTING MACHINE

[75] Inventor: Martin Prummer, Hasbergen, Germany

[73] Assignee: Technotrans AG, Sassenberg, Germany

[ * ] Notice: This patent is subject to a terminal disclaimer.

[21] Appl. No.: 09/096,364

[22] Filed: Jun. 15, 1998

[30] Foreign Application Priority Data

Sep. 15, 1997 [DE] Germany ..... 297 16 582 U

[51] Int. Cl.[6] ..... F25B 27/00; F28D 7/10; B41F 23/04

[52] U.S. Cl. ..... 62/238.6; 62/331; 165/140; 101/487

[58] Field of Search ..... 165/140; 101/487; 62/238.1, 238.6, 331

[56] References Cited

U.S. PATENT DOCUMENTS

| | | | |
|---|---|---|---|
| 2,505,774 | 5/1950 | Holm et al. | 165/140 |
| 2,541,069 | 2/1951 | Jones et al. | 165/140 |
| 4,059,882 | 11/1977 | Wunder | 29/157.3 A |
| 4,274,481 | 6/1981 | Ireland et al. | 165/122 |
| 5,462,113 | 10/1995 | Wand | 165/167 |
| 5,657,637 | 8/1997 | Mertens | 62/175 |
| 5,720,221 | 2/1998 | Harig et al. | 101/148 |
| 5,749,295 | 5/1998 | Kurz | 101/350.1 |

FOREIGN PATENT DOCUMENTS

| | | |
|---|---|---|
| 0 693 372 A1 | 1/1996 | European Pat. Off. . |
| 0 713 767 A1 | 5/1996 | European Pat. Off. . |
| 40 00 912 C1 | 5/1991 | Germany . |
| 94 13 439 U | 1/1995 | Germany . |
| 44 26 083 A1 | 1/1996 | Germany . |
| 295 20 464 U1 | 4/1996 | Germany . |
| 44 42 072 A1 | 5/1996 | Germany . |
| 296 08 045 U1 | 9/1996 | Germany . |
| 196 28 561 C1 | 9/1997 | Germany . |

*Primary Examiner*—William Doerrler
*Attorney, Agent, or Firm*—Griffin, Butler, Whisenhunt & Szipl, LLP

[57] ABSTRACT

In an assembly for controlling the temperature of a fountain fluid and/or selected rollers of a printing machine, which includes a fountain fluid circulating system, a cooling fluid circulating system, a refrigerant circulating system, and a means for selectively operating one or, simultaneously, more than one of the circulating systems, a common heat exchanging means is provided. The common heat exchanging means comprising a plurality of flow passages disposed in heat exchanging adjacent relationship with each other, and a distributing means for connecting each of the circulating systems to a selected series of flow passages of the common heat exchanging means. Adjacent flow passages can be connected to different circulating systems for heat exchange therebetween. The temperature-controlling assembly therefore can be operated in different heat exchanging functions.

7 Claims, 3 Drawing Sheets

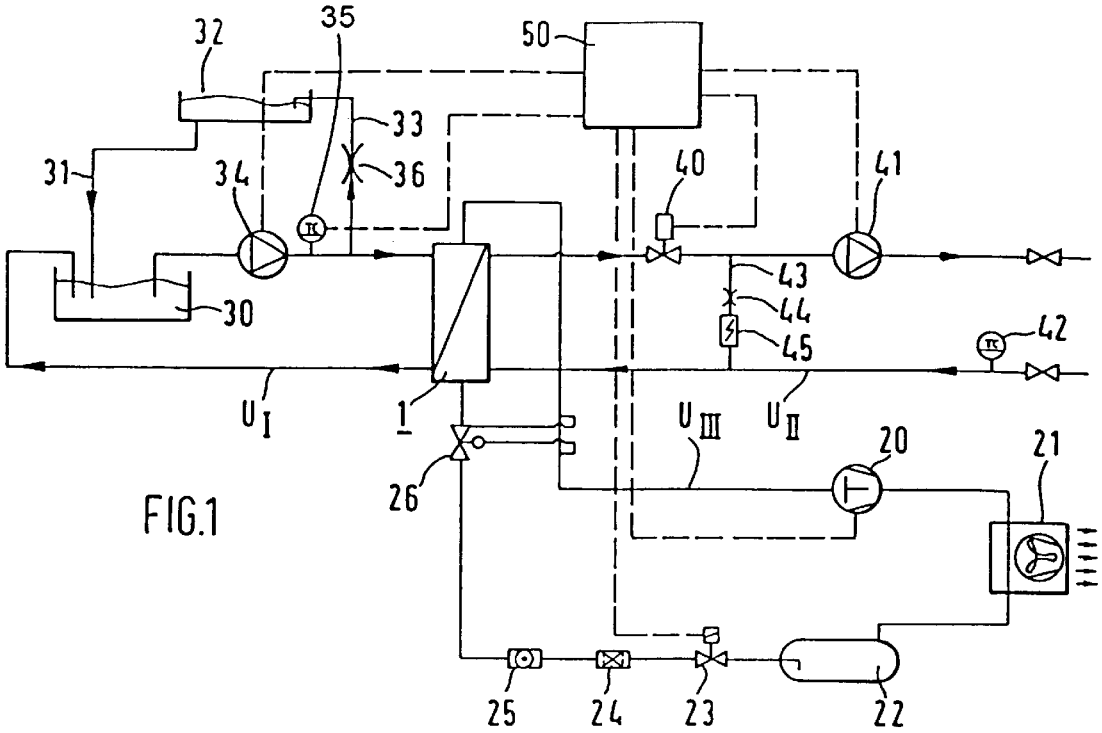
FIG.1
FIG. 2
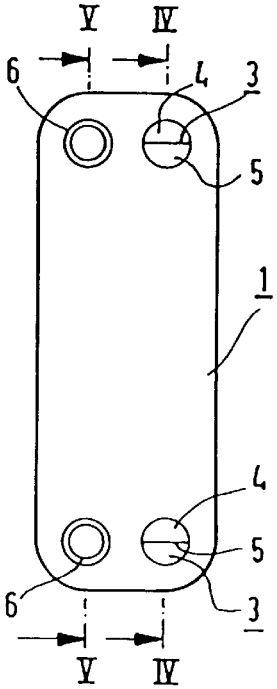
FIG.3
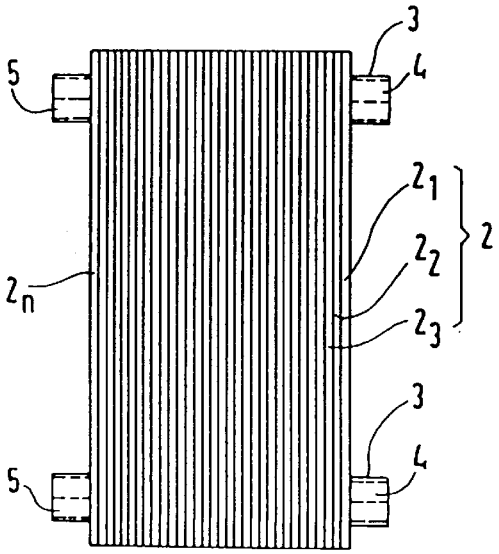

ASSEMBLY FOR CONTROLLING THE TEMPERATURE OF A FOUNTAIN FLUID AND/OR SELECTED ROLLERS OF A PRINTING MACHINE

BACKGROUND OF THE INVENTION

The invention relates to an assembly for controlling the temperature of a fountain fluid and/or selected rollers of a printing machine. The invention relates in particular to an assembly including a fountain fluid circulating system for supplying a fountain fluid application means with a fountain fluid, and a cooling fluid circulating system for supplying a roller cooling means with a cooling fluid.

DESCRIPTION OF THE PRIOR ART

In temperature controlling assemblies of the present type, such as known e.g. from DE-U-296 08 054, DE-A-44 26 083, EPA-693 372, for heat exchange with a refrigerant of a refrigerator a separate heat exchanger is provided in each of the fountain fluid and cooling fluid circulating systems. Each heat exchanger is either supplied individually with cold energy from the refrigerator or its cold energy is supplied to one of the heat exchangers only, e.g that of the fountain fluid circulating system. The directly cooled fountain fluid can thereafter be passed through the heat exchanger of the cooling fluid circulating system for heat exchange with the cooling fluid. Due to their structural complexity the prior assemblies are relatively expensive both as regards their initial costs and their operating and maintenance costs. Moreover, these assemblies can be operated in a single heat exchanging function only.

An object of the invention is to provide an improved temperature controlling assembly of a type mentioned hereinabove which is less complicated and involves less initial and maintenance costs. Another object is to provide a temperature controlling assembly which may be operated with different heat exchanging functions. A further object of the invention is to provide a temperature controlling assembly which permits a change from one heat exchanging function to another whilst the basic structure of the temperature controlling assembly may remain unaltered.

SUMMARY OF THE INVENTION

According to the present invention an assembly for con trolling the temperature of a fountain fluid and/or selected rollers of a printing machine is provided, which includes a fountain fluid circulating system for supplying a fountain fluid application means with a fountain fluid, a cooling fluid circulating system for supplying a roller cooling means with a cooling fluid, a refrigerator including a refrigerant circulating system, said refrigerant circulating system is in heat-exchanging relationship with at least one of the fountain fluid and the cooling fluid circulating systems, and a means for selectively operating one or, simultaneously, more of the circulating systems. In the temperature controlling assembly according to the present invention a common heat exchanging means is associated with all three circulating systems. This common heat exchanging means comprises a plurality of flow passages disposed in heat exchanging relationship with each other, and a distributing means for connecting a selected one of the fountain fluid circulating system, the cooling fluid circulating system and the refrigerant circulating system to a predetermined series of flow passages whereby adjacent flow passages can be communicated with different circulating systems.

Thus an important feature of the temperature-controlling assembly in accordance with the present invention is a single three-media heat exchanging means which replaces a number of individual heat exchangers required hitherto in the prior assemblies. The fluids of the circulating systems can thereby be placed in different heat exchanging relationships with each other in order to realise a plurality of heat exchanging functions. An assembly according to the invention can thus easily be adapted to different application requirements without the necessity to change the basic structure of the assembly itself. Only a re-arrangement of the single three-media heat exchanging means is required. For this purpose, one only needs to replace a distributing means adapted for one heat exchanging function by another distributing means adapted to another heat exchanging function, whilst the basic structure of the heat exchanging means itself being otherwise unaltered. Despite a high degree of flexibility and adaptability of the assembly according to the present invention, it costs less than the known assemblies. Namely because the costs of a three-media heat exchanging means in accordance with the invention may only slightly exceed the costs of a single conventional heat exchanger.

BRIEF DESCRIPTION OF THE DRAWINGS

Other objects and advantages achieved by the present invention will become apparent from the following detailed description of a preferred embodiment, in which:

FIG. 1 shows as a schematic diagram a temperature-controlling assembly in accordance with the present invention, FIG. 2 shows as a detailed side view a three-media heat exchanging means of the temperature-controlling assembly of FIG. 1, FIG. 3 shows as a front view the heat exchanging means of FIG. 2, FIGS. 4A and 4B show as sectional, schematic views taken along the section lines VI—VI and V—V of FIG. 2 the heat exchanging means set for a first heat exchanging function.

DESCRIPTION OF THE PREFERRED EMBODIMENT

Figure 4A:
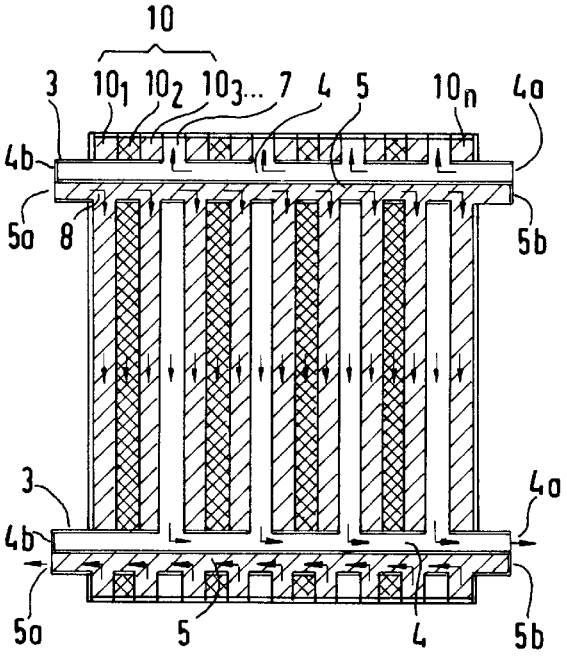

With reference to the drawings FIG. 1 shows a temperature-controlling assembly in accordance with the present invention which comprises a fountain fluid circulating system $U_I$, a cooling fluid circulating system $U_{II}$, and a refrigerant circulating system $U_{III}$.

The fountain fluid circulating system $U_I$ is formed as an open loop system and includes a buffer storage tank 30 for holding a suitable quantity of fountain fluid. A pump 34 and a temperature sensor 35 are disposed one behind the other downstream of the buffer storage tank 30. A conduit 33 is branched off from the main loop of the fountain fluid circulating, downstream of the temperature sensor 35, for guiding a portion of the fountain fluid circulating in the main loop to a container 32 of a fountain fluid application means (not shown). The fountain fluid is returned from container 32 into the buffer storage tank 30 through a conduit 31 communicating the tank 30 with the container 32. Suitable means, e.g. in the form of a through flow restricting throttle 36, is disposed in the branched-off conduit 33 for ensuring that the quantity of fountain fluid branched-off from the main loop and flowing in the conduit 33 is always less than the quantity of the fluid circulating in the main loop of the fountain fluid circulating system $U_I$.

The fountain fluid circulating in the main loop of the circulating system $U_I$ is passed through a three-media heat exchanging means bearing the general reference number 1 in FIG. 1 and will be discussed in more detail hereinafter.

The cooling fluid circulating system $U_{II}$, which is preferably formed as a closed system, includes, upstream of a roller cooling means (not shown), a control valve 40 and a pump 41, and, downstream of the roller cooling means, a temperature sensor 42. Further the cooling fluid circulating in the circulating system $U_{II}$ is passed through the three-media heat exchanging means 1. A by-pass conduit 43, downstream of the control valve 40, interconnecting the supply and return flow portions of the circulating system $U_{II}$ includes a throttle 44 for limiting the rate of cooling fluid flowing through the by-pass conduit 43, and a heating means 45.

The refrigerant circulating system $U_{III}$ is part of a refrigerator which, in a manner known per se, comprises at least a single compressor 20, a condenser 21, a collecting tank 22, a control valve 23 preferably in the form of a solenoid valve, a dryer 24, an inspection glass 25, and an expansion valve 26. Part of the refrigerant circulating system $U_{III}$ is further the three-media heat exchanging means 1 in that the refrigerant is also passed therethrough, thereby the fluids of all three circulating systems $U_I$, $U_{II}$, $U_{III}$ are passed through the three-media heat exchanging means 1. The refrigerant circulating system $U_{III}$ is usually formed as a closed system.

A control means 50 is provided for operating either one of the circulating system $U_I$ or $U_{II}$ independently of one another or both of the systems by switching on or switching off the pumps 34 and 41 of the fountain fluid and cooling fluid circulating systems $U_I$, $U_{II}$, respectively, for supplying cold energy from the refrigerant circulating system $U_{III}$ to the circulating systems $U_I$, $U_{II}$ responding to the specific heat exchanging function set in the three-media heat exchanging means 1, which will be discussed in more detail hereinafter.

Reference will be made hereinafter to FIG. 2 which shows the three-media heat exchanging means 1. The terms "above" and "below" relate to the position of the components of the heat exchanging means 1 as shown in the drawing. However, the invention is not restricted to usage of the heat exchanging means in such a position.

As is shown in FIGS. 2 and 3, the heat exchanging means 1 is preferably formed as a plate exchanger consisting of a plurality of plates 2, e.g. plates $\mathbf{2}_1$, $\mathbf{2}_2$, $\mathbf{2}_3$, . . . , $\mathbf{2}_n$ arranged side-by-side and one behind the other, with complementary slots or grooves formed in the surfaces of the plates 2 so that flow passages 10 each having an inlet end and an outlet end are formed between adjacent plates 2. A fluid, e.g. water, can thus be fed by way of a distributing means into a selected flow passage 10 and then discharged therefrom after it has passed through the selected flow passage 10. The flow passages 10 are hermetically sealed against each other and may extend along the plates 2 in a meander-like manner or in other suitable manner.

The distributing means comprises a two-chamber distributing device 3 for separately supplying the fountain and cooling fluids from the fountain and cooling fluid circulating systems $U_I$, $U_{II}$, and a single chamber distributing device 6 for supplying the refrigerant from the circulating system $U_{III}$, to the associated flow passages 10. Each two-chamber distributing device 3 and single chamber distributing device 6 comprises a distributor tube close to the upper ends of the flow passages 10 and a distributor tube close to the lower ends thereof. The distributor tubes extend, preferably parallel to one another, axially through the heat exchanger 1 and are accommodated in aligned accommodating bores in the plates 2.

Each distributor tube of the two-chamber distributing device 3 includes an upper longitudinal chamber 4 and a lower longitudinal chamber 5 hermetically sealed against each other by a partition wall disposed therebetween. The upper chamber 4 has open and closed axial ends 4*a*, 4*b*, and likewise, the lower chamber 5 has open and closed axial ends 5*a*, 5*b*. For facilitating the communication of the distributor tubes to the respective circulating systems $U_I$, $U_{II}$, the open axial end 4*a* of the upper chamber 4 is located adjacent the closed axial end 5*b* of the lower chamber 5 and the closed axial end 4*b* of the upper chamber 4 is located adjacent the open axial end 5*a* of the lower chamber 5.

Figure 4B:
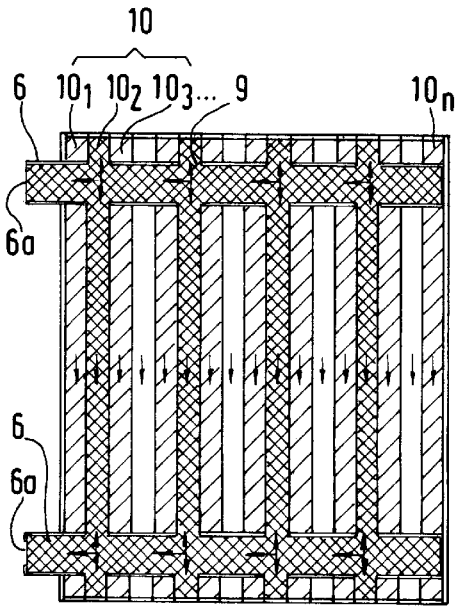

As is shown in FIG. 4B, the single chamber distributing device 6 comprises upper and lower distributor tubes, each of which has an open axial end 6*a* for the supply or discharge of the refrigerant of the refrigerant circulating system $U_{III}$ and an oppositely located closed end.

Openings 7, 8 for connecting the interior of the chamber 4 or 5 to selected flow passages 10 are provided at predetermined axial intervals along each distributor tube of the two-chamber distributing device 3 so that the fluid supplied to the chamber 4 or 5 is only admitted into a predetermined number of flow passages 10. In like manner, openings 9 for passing the refrigerant introduced into the single chamber distributing device 6 to selected flow passages 10 are provided at predetermined axial intervals along each distributor tube of the single chamber distributing device 6. Consequently different fluids can be supplied to adjacent flow passages 10 for placing these fluids in heat exchanging relationship with each other.

Different heat exchanging functions can be obtained in dependence on the order in which the flow passages 10 are supplied by a fluid, as will be discussed hereinafter in greater detail with reference to FIGS. 4A, 4B; 5A, 5B and 6A, 6B.

First Heat Exchanging Function

The first heat exchanging function is shown in FIGS. 4A and 4B and is characterized by the fact that the refrigerant is supplied to the single chamber distributing device 6 connected to the refrigerant circulating system $U_{III}$. The openings 9 formed therein communicate with the series of flow passages $\mathbf{10}_2$, $\mathbf{10}_6$, $\mathbf{10}_{10}$, $\mathbf{10}_{14}$, etc as is indicated in FIGS. 4A and 4B by cross-hatching lines. Accordingly, each upper and lower distributor tube has openings 9 located along the length thereof at an axial spacing corresponding to the sequence of four successively disposed flow passages 10.

Openings 7, which connect the upper chamber 4 connected to the cooling fluid circulating system $U_{II}$ to the flow passages $\mathbf{10}_4$, $\mathbf{10}_8$, $\mathbf{10}_{12}$, etc, are provided in each distributor tube of the two-chamber distributing device 3. Consequently, the cooling fluid of the circulating system $U_{II}$ supplied to the chamber 4 can only flow into these selected flow passages, as is indicated in FIGS. 4A and 4B by the unhatched areas. The series of openings 9 in the lower chamber 5 of the two-chamber distributing device 3 connected to the fountain fluid circulating system $U_I$ is such that the fountain fluid circulating in the circulating system $U_I$ is only supplied to the flow passages $\mathbf{10}_1$, $\mathbf{10}_3$, $\mathbf{10}_5$, etc as is illustrated by the hatching in FIGS. 4A and 4B.

In this manner, a flow passage, e.g. $10_2$, for the refrigerant comes to lie between a pair of flow passages, e.g. $10_1$, $10_3$, for the fountain fluid and a flow passage, e.g. $10_4$, for the cooling fluid comes between a pair of flow passages, e.g. $10_3$, $10_5$, for the fountain fluid. Cold energy can thereby be conveyed directly from the refrigerant to the fountain fluid but cannot be conveyed directly to the cooling fluid. Rather, the cooling fluid can only obtain cold energy from the directly cooled fountain fluid.

Thus, the first heat exchanging function enables the cold energy to be conveyed primarily to the fountain fluid circulating system $U_I$. Excess cold energy can be stored in the buffer storage tank 30 and this can be passed on to the cooling fluid circulating system $U_{II}$ as necessary via the heat exchanging means 1.

Second Heat Exchanging Function

Figure 5A:
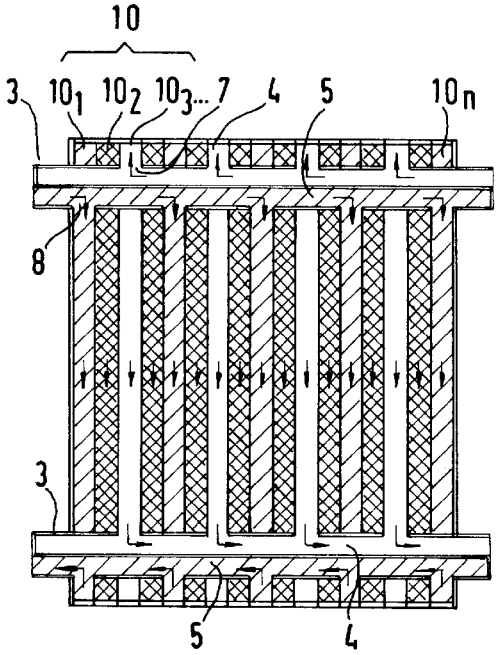
FIGS. 5A and 5B show as sectional views similar to FIGS. 4A and 4B the heat exchanging means set for a second heat exchanging function.
Figure 5B:
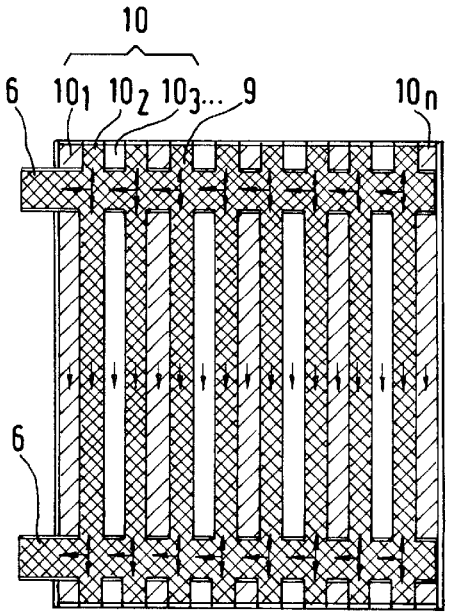

The second heat exchanging function is shown in FIGS. 5A and 5B and is characterized by the fact that, in analogy with the previously described mode, the openings 9 of the single chamber distributing device 6 are spaced such that the refrigerant is supplied to a series of flow passages $10_2$, $10_4$, $10_6$, etc. By contrast, the openings 7, 8 of the two-chamber distributing device 3 are disposed such that the flow passages $10_3$, $10_6$, $10_9$, etc are supplied with the fountain fluid and the flow passages $10_1$, $10_5$, $10_9$, $10_{13}$, etc are supplied with the cooling fluid. This means that the refrigerant is in direct heat exchanging relationship with either one of the other fluids without them being in direct heat exchanging relationship with one another.

The second heat exchanging function allows the fountain fluid and the cooling fluid to be cooled to substantially the same temperature without mutual interaction.

Third Heat Exchanging Function

Figure 6A:
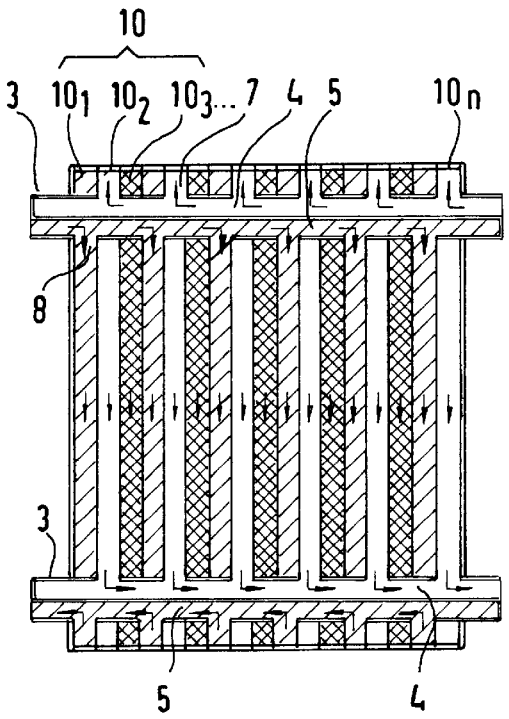
FIGS. 6A and 6B show as sectional views similar to FIGS. 4A and 4B the heat exchanging means set for a third heat exchanging function.
Figure 6B:
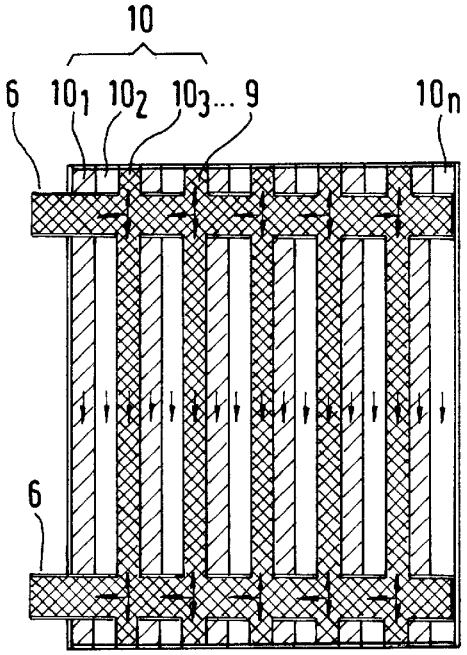

The third heat exchanging function is shown in FIGS. 6A and 6B and is characterized by the fact that the flow passages $10_3$, $10_6$, $10_9$, etc are supplied with the refrigerant, whilst the openings 7, 8 of the two-chamber distributing device 3 are disposed such that the flow passages $10_2$, $10_5$, $10_8$, $10_{11}$, etc are supplied with the fountain fluid and the flow passages 101, 104, 107, 1010, etc are supplied with the cooling fluid.

The result is that the refrigerant is in direct heat exchanging relationship with either one of the other two fluids, but, in addition, these other two fluids are also in direct heat exchanging relationship with each another. Thus, in the case of the third heat exchanging function, there is a direct heat exchanging relationship between all of the fluids. This allows a buffer storage tank similar to the buffer storage tank 30 to be integrated into both of the circulating systems $U_I$ and $U_{II}$.

Other heat exchanging functions are possible. The heat exchange between adjacent flow passages 10 preferably occurs in the form of a counterflow whereby the fluid flow through adjacent passages is in opposite directions.

Each of the openings 7, 8, 9 in the distributor tubes of the two-chamber distributing device 3 or of the single chamber distributing device 6 may, in correspondence with the heat exchanging function desired, be soldered to the relevant flow passages 10 or may be hermetically sealed thereto in some other manner. A plate exchanger of basically unaltered basic construction can thereby be utilised. The distributor tubes 3, 6 could also be arranged in exchangeable manner so as to be able to reset a heat exchanging means in accordance with the invention for another heat exchanging function by simply exchanging the two-chamber distributing device 3 and/or the single chamber distributing device 6. Finally, separate single chamber distributing devices for each fluid could be provided instead of a two-chamber distributing device.

The operation of the temperature-controlling assembly in accordance with the invention using the three-media heat exchanging means 1 in the first heat exchanging function will be described hereinafter with renewed reference to FIG. 1.

Cooling Only of the Fountain Fluid

With the refrigerator switched on and hence refrigerant being supplied to the three-media heat exchanging means 1, the pump 34 is set in motion whilst the pump 41 in the cooling fluid circulating system $U_{II}$ remains unoperated. The buffer storage tank 30 is thereby supplied continuously with cooled fountain fluid. A portion of the fountain fluid circulated through the circulating system $U_{II}$ by the pump 34 circulates through the branched conduit 33 into the storage container 32 for further processing by the fountain fluid application means. The pump 34 is dimensioned such that an adequate volume of fountain fluid always passes through the three-media heat exchanging means 1. The cooling of the fountain fluid in the three-media heat exchanging means 1 occurs in dependence on the fountain fluid temperature detected by the temperature sensor 35 on the downstream side of the buffer storage tank 30.

Cooling of the Fountain Fluid and the Cooling Fluid

The pumps 34 and 41 are operated so that all three fluids pass through the three-media heat exchanging means 1 when the refrigerator is switched on. The cooling fluid flowing through the three-media heat exchanging means 1 extracts cold energy from the fountain fluid cooled as a consequence of the direct heat exchange with the refrigerant, whereby the buffer storage tank 30 ensures that a sufficient quantity of fountain fluid is always available for cooling the cooling fluid. This operation can be further assisted by setting the temperature of the fountain fluid in the circulating system $U_I$ to a sufficiently low value.

Setting of a cooling fluid temperature that is suitable for the roller application means is effected with the aid of the control valve 40 which is controlled in dependence on the temperature measured by the downstream temperature sensor 42.

If the temperature of the cooling fluid is too low, the heating means 45 in the by-pass conduit 43 can be switched on so as to heat up a portion of cooling fluid continuously flowing through the by-pass conduit 43.

Cooling of Only the Cooling Fluid

This mode corresponds essentially to that previously described with the exception that the refrigerator is only switched on when needed since the cold energy required for cooling the cooling fluid is extracted as a first resort from the quantity of fountain fluid stored in the buffer storage tank 30. The energy loss due to the circulation of the fountain fluid through the secondary loop of the fountain fluid circulating system $U_I$ is negligibly small since the fountain fluid application means is switched off. If necessary, a shut off valve could be disposed in the branch conduit 33 so as to completely shut off the flow of fountain fluid through the secondary loop.

Although this has not been described in detail, it is self-evident that various other modes of operating the temperature-controlling assembly could be implemented in correspondence with the set heat exchanging function of the three-media heat exchanging means. In particular, in the case of the second or third heat exchanging functions, a direct conveyance of cold energy from the refrigerant in the refrigerant circulating system $U_{III}$ to the other two fluid media may be provided, which can be advantageous when the cold energy requirements of the roller cooling means fed by the cooling fluid circulating system $U_{II}$ are very high.

It will be readily observed from the foregoing detailed description of the invention and from the illustrations thereof that numerous other variations and modifications may be made without departing from the true spirit and scope of the novel concepts or principles of the invention.

What is claimed is:

1. A temperature-controlling assembly for controlling the temperature of a fountain fluid and/or selected rollers of a printing machine including a fountain fluid circulating system for supplying a fountain fluid application means with a fountain fluid, a cooling fluid circulating system for supplying a roller cooling means with a cooling fluid, a refrigerator including a refrigerant circulating system in direct heat-exchanging relationship with one of the fountain fluid and cooling fluid circulating systems, means for selectively operating one or, simultaneously, more than one of the circulating systems, a common heat exchanging means comprising a plurality of flow passages disposed in heat exchanging relationship with each other, and distributing means for connecting each of the circulating systems to a selected series of said flow passages, wherein each flow passage connected with the refrigerant circulating system is disposed between a pair of flow passages connected with the fountain fluid circulating system, and each flow passage connected with the cooling fluid circulating system is disposed between a pair of flow passages connected with the fountain fluid circulating system.

2. The temperature-controlling assembly in accordance with claim 1, wherein the distributing means comprises a multi-chamber distributing device, each chamber thereof being connected with one of the fountain fluid and the cooling fluid circulating systems and having a number of axially spaced openings aligned with a selected series of inlet/outlet openings of the flow passages for introducing the fountain fluid of the fountain fluid circulating system and the cooling fluid of the cooling fluid circulating system into selected flow passages.

3. The temperature-controlling assembly in accordance with claim 1, wherein the fountain fluid circulating system is an open circulating system.

4. The temperature-controlling assembly in accordance with claim 3, wherein the fountain fluid circulating system comprises a buffer storage tank for supplying the fountain fluid application means.

5. The temperature-controlling assembly in accordance with claim 3, wherein a secondary circulating system is provided, said secondary circulating system being branched off from the fountain fluid circulating system, means for restricting the quantity of fountain fluid flowing in the secondary circulating system to be less than the quantity of fountain fluid flowing in the fountain fluid circulating system.

6. The temperature-controlling assembly in accordance with claim 1, further including a control means for maintaining the temperature of the fountain fluid in the fountain fluid circulating system below that of the cooling fluid in the cooling fluid circulating system.

7. The temperature-controlling assembly in accordance with claim 1, wherein the cooling fluid circulating system includes a control valve for controlling the fluid volume stream responding to the temperature of the cooling fluid at the output side of the roller cooling means.

* * * * *